United States Patent [19]

Abbott et al.

[11] Patent Number: 4,865,958

[45] Date of Patent: Sep. 12, 1989

[54] PHOTOGRAPHIC RECORDING MATERIAL COMPRISING LEUCO DYE FOR COLD SILVER IMAGE TONE

[75] Inventors: Thomas I. Abbott; Robert E. Dickerson; Michael P. Youngblood, all of Rochester, N.Y.

[73] Assignee: Eastman Kodak Company, Rochester, N.Y.

[21] Appl. No.: 233,410

[22] Filed: Aug. 18, 1988

[51] Int. Cl.[4] ..... G03C 7/26

[52] U.S. Cl. ..... 430/542; 430/364; 430/565; 430/965

[58] Field of Search ..... 430/542, 364, 965, 367, 430/565

[56] References Cited

U.S. PATENT DOCUMENTS

| | | | |
|---|---|---|---|
| 3,880,658 | 4/1975 | Lestina et al. | 430/559 |
| 3,938,995 | 2/1976 | Gompf et al. | 430/367 |
| 4,022,617 | 5/1977 | McGuckin | 430/203 |
| 4,035,184 | 7/1977 | Faul et al. | 430/542 |
| 4,374,921 | 2/1983 | Frenchik | 430/617 |
| 4,390,606 | 6/1983 | Gabrielsen et al. | 430/542 |
| 4,423,126 | 12/1983 | Kliganowicz et al. | 430/542 |

FOREIGN PATENT DOCUMENTS 56-133733 10/1981 Japan .

*Primary Examiner*—Richard L. Schilling
*Attorney, Agent, or Firm*—Thomas F. Kirchoff

[57] ABSTRACT

A photographic recording material is described which comprises a leuco dye which is capable of generating a blue tone in a developed silver image.

8 Claims, No Drawings

PHOTOGRAPHIC RECORDING MATERIAL COMPRISING LEUCO DYE FOR COLD SILVER IMAGE TONE

The present invention relates to a photographic recording material and in particular to a photographic recording material having an improved silver image tone.

Warm silver image tones are not desirable in certain silver halide based photographic materials, particularly, for example in radiographic products. Methods to shift a so-called warm tone to colder tones are known. Frequently, however, such attempts have resulted in adverse effects, such as for example a diminution of desirable photographic properties. One method is described in Japanese Patent Publication No. 56-133,733 and relates to a technique for altering the tone of black and white printing paper. This technique is based on exposure of the paper through a black filter, which paper is then heated, developed, fixed and washed in order to be able to view the resulting image.

U.S. Pat. No. 4,022,617 describes use of leuco dyes in photothermographic systems for the purpose of altering tone and density in the resulting image. U.S. Pat. No. 4,374,921, which also relates to photothermographic systems, describes use of indoaniline leuco dyes for altering image density and tone.

Notwithstanding these published attempts to alter image tones there is still a need for a reliable method to obtain cold image tones in photographic recording materials, particularly in radiographic products, without adversely affecting the otherwise desirable photographic properties.

Accordingly, the object of the present invention is to provision of a light sensitive photographic recording material which has improved cold image tones, which improvement causes no adverse effect on the sensitometric properties of the recording material.

The present invention is based upon a photographic recording mateiral comprising a silver halide emulsion layer and a leuco dye compound which is capable of generating, in an imagewise manner, a blue tone without causing adverse effects on desirable photographic properties.

The leuco dye compound suitable for use in this invention can have the structural formula:

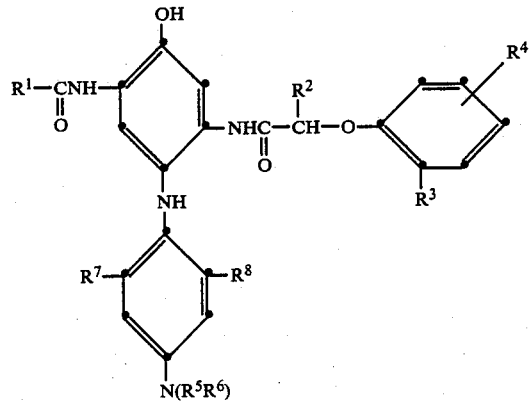

wherein:

$R^1$ is an unsubstituted or a substituted aliphatic group having from 1 to about 20 carbon atoms;

$R^2$ is hydrogen; an unsubstituted or a substituted, straight or branched chain alkyl group having from 1 to about 10 carbon atoms; an unsubstituted or a substituted cycloalkyl group having from 3 to about 8 carbon atoms in the ring; or an aryl group having from 6 to about 10 carbon atoms;

$R^3$ is hydrogen; an unsubstituted or a substituted alkyl group having from 1 to about 10 carbon atoms; an unsubstituted or a substituted aryl group having from 6 to about 10 carbon atoms; an unsubstituted or a substituted cycloalkyl group having from 3 to about 8 carbon atoms in the ring; nitro; or cyano;

$R^4$ is as defined for $R^3$, or $R^4$ can be hydroxy, sulfo or carboxy;

$R^3$ and $R^4$, alone or in combination, can constitute a ballast group;

$R^5$ is a hydroxyalkyl; alkylsulfonamidoalkyl; alkoxyalkyl or alkylsulfonic acid wherein the alkyl or alkoxy group has from 1 to about 12 carbon atoms and the aryl group has from 6 to about 10 carbon atoms;

$R^6$ is as defined for $R^5$;

$R^7$ is hydrogen, alkyl, alkoxy, sulfoalkyl or sulfoaryl; and $R^8$ is as defined for $R^7$.

Aliphatic groups which can be represented by $R^1$ include straight or branched chain alkyl groups having from 1 to about 20 carbon atoms and olefinic or acetylenic groups having from 1 to about 20 carbon atoms. Preferred aliphatic groups are alkyl having from 1 to about 12 carbon atoms which can be straight or branched chain and which can be unsubstituted or substituted. Substituents on the aliphatic $R^1$ groups can be one or more halogen atoms, preferably fluoro, or, nitro, cyano or amino groups. The $R^1$ group can serve as a ballast group to assure that the leuco dye compound does not migrate from the layer in which it is coated.

Alkyl groups which can be represented by $R^2$, $R^3$, $R^4$, $R^5$, $R^6$, $R^7$ or $R^8$ preferably comprise from 1 to about 6 carbon atoms and can be straight or branched chain.

Alkoxy groups which can be represented by $R^5$, $R^6$, $R^7$ or $R^8$ preferably comprise from 1 to 6 carbon atoms.

Cycloalkyl groups represented by $R^2$, $R^3$ or $R^4$ preferably comprise 5 or 6 carbon atoms, such as cyclopentyl or cyclohexyl groups.

Aryl groups which can be represented by $R^2$ $R^3$, $R^4$, $R^5$, $R^6$, $R^7$ or $R^8$ preferably comprise phenyl. The aryl groups can be substituted with alkyl or alkoxy groups comprising from 1 to about 5 carbon atoms or with halogen, nitro or cyano groups.

Preferred blue forming leuco dye compounds which are suitable for use in this invention include the following:

1.

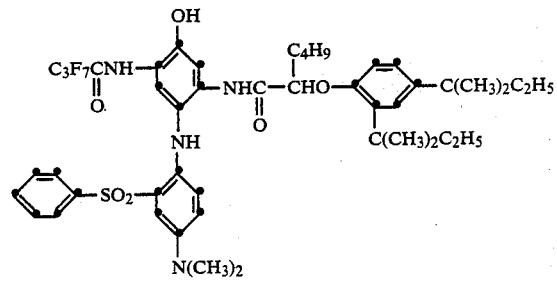

-continued

2.

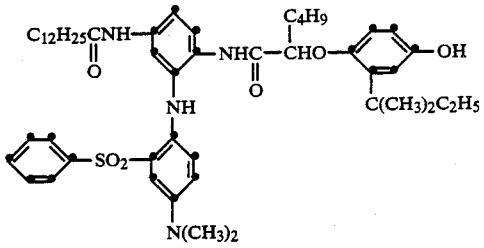

3.

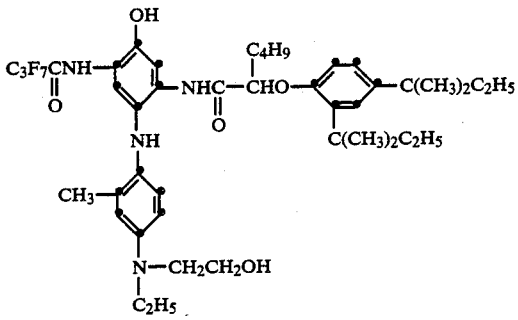

4.

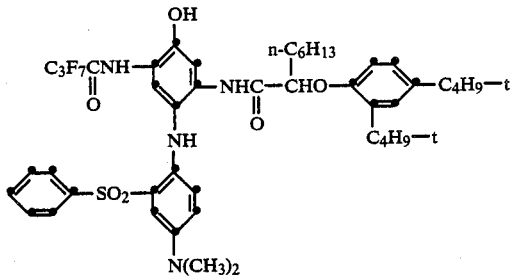

5.

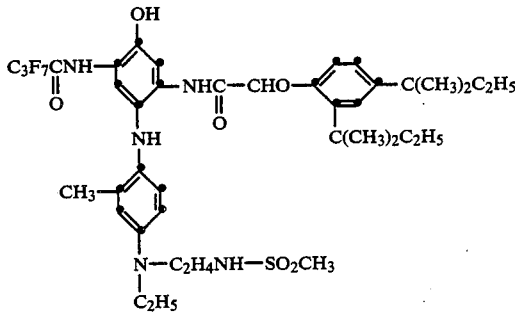

Leuco dyes which are useful in the present invention can be made according to well-known procedures in the art, such as for example, those described in James, *The Theory of the Photographic Process,* 4th ed., pages 341–343, 1977, MacMillan, New York, and U.S. Pat. Nos. 2,895,955; 3,148,187; and 3,423,207.

Leuco dyes are described in *The Theory of the Photographic Process* as being intermediate compunds used in dye formation. they are generally colorless compounds and are simultaneously considered as both products of coupling and precursors of dyes. Conversion of leuco dye to dye depends upon an oxidation reaction, usually with developing agent, with accompanying removal of an atom or a group, as is illustrated by equation 12.20 in the above-noted reference.

The leuco compound is preferably ballasted in order to prevent it from migrating between layers of a photograhic element and to prevent the newly formed dye from being washed out of the element during processing.

The blue forming leuco dye compound can be incorporated in a silver halide emulsion layer in an amount of from about 50 to about 300 mg/meter$^2$, preferably from about 150 to about 250 mg thereof/meter$^2$ of coated surface. If desired, several leuco dyes can be combined and incorporated into a silver halide emulsion layer.

The silver halide grains can be either 3-dimensional or tabular. The 3-dimensional grains can have a mean grain size of from about 0.4 to about 5 μm, preferably from about 0.6 to about 1.5 μm. The tabular silver halide grains are described by both diameter and thickness. The diameter of tabular grains can be from about 0.4 to about 10 μm, preferably from about 0.6 to about 4 μm, and the thickness can be from about 0.03 to about 0.2 μm, preferably from about 0.06 to about 0.10 μm. Diameter refers to the diamter of a circle having an area equal to the projected area of the grain. Thickness describes the distance between the two parallel planes of a tabular grain.

Mean grain size is a term well understood by those skilled in the art, as illustrated by Mees and James, The Theory of the Photographic Process, 3rd Ed., MacMillan 1966, Chapter 1, pages 36–43. It has been noted for 3-dimensional grains that as silver halide means grain sizes decrease, there is a tendency for images produced therefrom to become increasingly warmer, that is of a more brown rather than black appearance. For tabular grains, a corresponding increase in warm imge tone is produced with decreasing grain thickness, i.e. as the grain thickness decreases the image tone become increasingly warmer.

The photograhic emulsions can be coated to provide emulsion layers in photographic recording materials of any desirable silver coverage. Conventional silver coating coverages fall within the range of from about 2 to about 10, preferably about 4 to about 6 grams thereof/meter$^2$ of coated surface.

Silver halide emulsion contain a vehicle in addition to silver halide grains. The proportion of vehicle can be widely varied, but typically is within the range of from about 2 to 10 grams/meter$^2$. The vehicle present in the emulsion, or in any other layers of the photograhic recording material, can be chosen from among conventinal vehicle. These include water permeable hydrophilic colloids employed alone or in combination with extenders such as gelatin, synthetic polymeric peptizers, carriers, latices, and binders. Such materials are more specifically described in Research Disclosure, Vol. 176, December 1978, Item 7643, Section IX, the disclosure of which is incorporated herein by reference. Vehicles are commonly employed with one or more hardeners, such as those described in Section X of this same Research Disclosure.

With respect to radiographic recording materials, it is common that Duplitized ® silver halide emulsion coatings are employed, one on either side of a support. In such situations the ranges of silver and vehicle coverages noted above would be twice that indicated.

Emulsions contemplated include those having silver halide grains of any conventional geometric form such as regular octahedral or cubic crystalline form or, preferably, tabular form. Such grains can be prepared by a variety of techniques, e.g. single-jet, double-jet (including continuous removal techniques), accelerated flow rate and interrupted precipitation techniques, as illustrated by Trivelli and Smith, The Photographic Journal, Vol. LXXIX, May, 1939, pages 330–338; T. H. James, The Theory of the Photographic Process, 4th Ed., Macmillan, 1977, Chaper 3; Terwillinger et al Research Disclosure, Vol. 149, September 1976, Item 14987; Research Disclosure, Vol. 225, January 1983, Item 22534 as well as in U.S. Pat. Nos. 2,222,264; 3,650,757; 3,917,485 (where pAg cycling is limited to permit surface development); and 3,790,387; as well as in German OLS No. 2,107,118 and U.K. Patent Nos. 1,335,925; 1,430,465 and 1,469,480. Double-jet accelerated flow rate precipitation techniques are preferred for forming monodispersed emulsions. Sensitizing compounds, such as compunds of copper, thallium, cadmium, rhodium, tungsten, thorium, iridium and mixtures thereof, can be present during precipitation of the silver halide emulsion, as illustrated in U.S. Pat. Nos. 1,195,432; 1,951,933; 2,448,060; 2,628,167; 2,950,972; 3,488,709 and 3,737,313.

Supports for photographic recording materials described herein can be any material which does not have an adverse effect on photographic properites and which is dimensionally stable. Typical flexible sheet materials which are useful as supports are described on page 85 of the November, 1976 edition of Research Disclosure, the disclosure of which is hereby incorporated by reference.

The following examples are provided as further illustrations of the invention.

EXAMPLE 1

A tabular grain silver bromoiodide (9 mol % I) emulsion having an equivalent circular diameter of 0.684 μ and a thickness of 0.07 μm was chemically sensitized with sulfur and gold and was spectrally sensitized with Dye A, identified below.

Two coatings of the above-described emulsion were made on poly(ethyleneterephthalate):

Coating 1

The emulsion was coated to provide 2.53 g Ag/m$^2$ and 4.3 g gelatin/m$^2$. The emulsion was hardened with 0.8% BVSME(1). An overcoat layer comprising 883 mg/m$^2$ gelatin was then applied to the emulsion coating. The overcoat layer was hardened with 0.8% BVSME.

(1) BVSME is bis(2-vinylsulfonylmethyl)ether

Coating 2

This coating was prepared as described above in Coating 1 except that the emulsion layer also contained a disperson of dibutylphthalate (431 mg/m$^2$) and leuco Dye 1 (215 mg/m$^2$) as described above.

Coatings 1 and 2 were both exposed for 0.02 seconds through a 0–3.0 density step tablet (0.15 density steps) to a tungsten light source on a Macbeth IB sensitometer equipped with a 0.29 neutral density filter and Wratten No. 61 filter, to give a simulated X-ray green screen exposure. Both coatings were processed in the developer formulation noted below for 60 seconds at 35° C. followed by fixing for 60 seconds at 35° C. in KODAK RP Fixer, and a 4 minute water wash at 35° C.

Dye A:

-continued

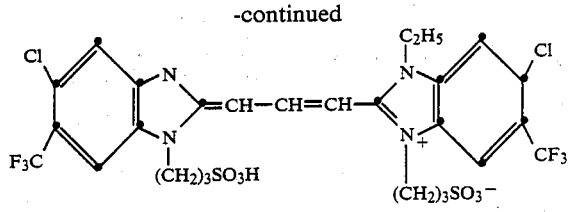

| Developer | |
|---|---|
| Potassium hydroquinone sulfonate | 10.0 g |
| 4-methyl-4-hydroxymethyl-1-phenyl-3-pyrazolidinone | 5.0 g |
| sodium sulfite | 30.0 g |
| potassium bromide | 1.0 g |
| sodium carbonate | 15.0 g |
| 5-nitroindazole | 0.1 g |
| water to make | 1.0 l |
| pH (adjusted with NaOH) | 10.0 |

Sensitometry and CIE 1976 (L*a*b*)-space colorimetric analyses were performed on Coatings 1 and 2. The results are shown in the following Table.

TABLE

| Coating | Contrast Index | Speed | Dmin | Dmax | Color Value |
|---|---|---|---|---|---|
| 1 | 0.90 | 170 | 0.04 | 1.59 | 4.58 |
| 2 | 0.92 | 167 | 0.05 | 1.57 | 1.00 |

The color value in the Table is the CIE 1976 (L*a*b*)-space value measured at a luminence of 30 (visual density of 1.20). The CIE 1976 (L*a*b*)-space value measures blueness or yellowness of the hue of an image and can be quantified according to a formula relationship defined by the Commission Internationale de l'Eclairage. This formula, identified as the CIE 1976 (L*a*b*)-space, defines a color space where the quantity L* signifies perceived lightness with greater values indicating lighter tones. The quantity a* defines hue along a green-red axis with negative values indicating more green hue and positive vallues indicating more red hue, and the quantity b* defines hue along a yellow-blue axis with negative values indicating more blue hue and positive values indicating more yellow hue.

The CIE 1976 (L*a*b*)-space is defined by the equations:

$$l^* = 116\,(Y/Y_o)^{\frac{1}{3}} - 16$$

$$a^* = 500[(X/X_o)^{\frac{1}{3}} - (Y/Y_o)^{\frac{1}{3}}]$$

$$b^* = 200[(Y/Y_o)^{\frac{1}{3}} - (Z/Z_o)^{\frac{1}{3}}]$$

where $X_n$, $Y_n$, and $Z_n$ are the tristimulus values of the standard illuminant with $Y_n$ equal to 100. According to the formula, a desirable cool image tone would be signified by a blue hue, which would be indicated by more negative values for b*. A more detailed description of the CIE 1976 (L*a*b*)-space can be found in G. Wyszecki & W. S. Stiles, *Color Science, Concepts and Methods, Quantitative Data and Formulae,* J. Wiley & Sons, N.Y. (1982).

In the above Table the negative shift in Color Value of 3.58 units between Coatings 1 and 2, which is seen as a result of incorporation of leuco Dye 1, represents an easily visible shift from a very warm image tone for Coating 1 to a rather cold tone for Coating 2. A change of 0.7 units represents a just noticeable difference in color to most observers in a side-by-side comparison.

This invention has been described in detail with particular reference to preferred embodiments thereof. However, it will be understood that variations and modifications can be effected within the spirit and scope of the invention.

We claim:

1. A photographic recording material comprising a silver halide emulsion layer and a leuco compounds which, upon photographic processing, is capable of generating in an imagewise manner a blue tone in developed silver images wherein the leuco dye has the structural formula:

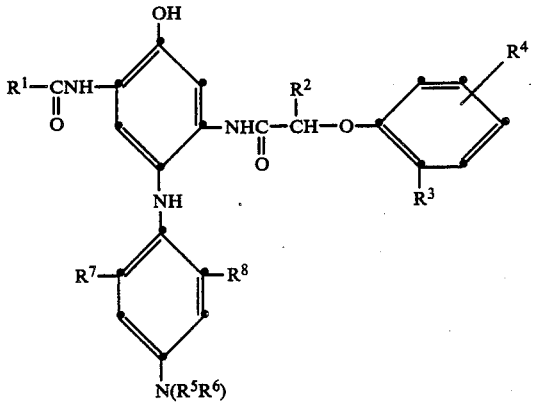

wherein:

$R^1$ is an unsubstituted or a substituted aliphatic group having from 1 to about 20 carbon atoms;

$R^2$ is hydrogen; an unsubstituted or a substituted, straight or branched chain alkyl group having from 1 to about 10 carbon atoms; an unsubstituted or a substituted cycloalkyl group having from 3 to about 8 carbon atoms in the ring; or an aryl group having from 6 to about 10 carbon atoms;

$R^3$ is hydrogen; an unsubstituted or a substituted alky group having from 1 to about 10 carbon atoms; an unsubstituted or a substituted aryl group having from 6 to about 10 carbon atoms; an unsubstituted or a substituted cycloalkyl group having from 3 to about 8 carbon atoms in the ring; nitro; or cyano;

$R^4$ is as defined for $R^3$, or $R^4$ can be hydroxy, sulfo or carboxy;

$R^5$ is hydroxylalkyl; alkylsulfonamidoalkyl; alkoxyalkyl; or alkylsulfonic acid wherein the akyl or alkoxy group has from 1 to about 12 carbon atoms or an aryl group having from 6 to about 10 carbon atoms;

$R^6$ is as defined for $R^5$;

$R^7$ is hydrogen, alkyl, alkoxy, sulfoalkoxy or sulfoaryl; and $R^8$ as defined for $R^7$.

2. A recording material according to claim 1 wherein $R^1$ is a straight or branched chain alkyl group having from 1 to about 20 carbon atoms.

3. A recording material according to claim 2 wherein $R^1$ comprises from 1 to about 12 carbon atoms.

4. A recording material according to claim 3 wherein $R^1$ is substituted with at least one halogen atom.

5. A recording material according to claim 4 wherein the halogen atom is fluorine.

6. A recording material according to claim 1 wherein $R^2$ is an alkyl group comprising from 1 to about 10 carbon atoms.

7. A recording material according to claim 1 wherein $R^3$ and $R^4$ are alkyl groups comprising from 1 to about 10 carbon atoms.

8. A recording material according to claim 1 wherein the leuco dye has the structural formula:

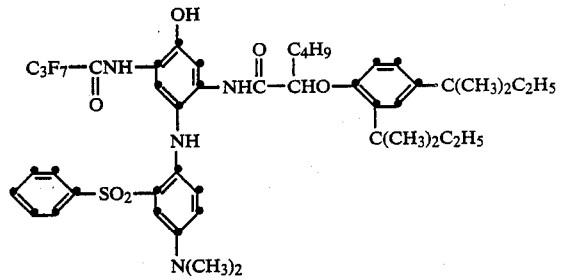

* * * * *